US011428049B2

(12) United States Patent
Sehsah et al.

(10) Patent No.: US 11,428,049 B2
(45) Date of Patent: Aug. 30, 2022

(54) WELLBORE UNDERREAMING

(71) Applicant: Saudi Arabian Oil Company, Dhahran (SA)

(72) Inventors: Ossama R. Sehsah, Dhahran (SA); Abdulrahman K. Aleid, Dhahran (SA); Ahmad A. Amoudi, Dhahran (SA); Sallal A. Aldawsari, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 0 days.

(21) Appl. No.: 17/014,867

(22) Filed: Sep. 8, 2020

(65) Prior Publication Data

US 2022/0074269 A1 Mar. 10, 2022

(51) Int. Cl.

| | |
|---|---|
| ***E21B 7/28*** | (2006.01) |
| ***E21B 23/00*** | (2006.01) |
| ***E21B 44/00*** | (2006.01) |
| ***E21B 47/09*** | (2012.01) |

(52) U.S. Cl.

CPC ..... *E21B 7/28* (2013.01); *E21B 23/006* (2013.01); *E21B 44/00* (2013.01); *E21B 47/09* (2013.01)

(58) Field of Classification Search

CPC ..... E21B 7/28; E21B 47/09; E21B 23/006; E21B 44/00; E21B 10/26

See application file for complete search history.

(56) References Cited

U.S. PATENT DOCUMENTS 3,832,851 A * 9/1974 Kiernan ..... F15B 11/0325 60/563
7,823,663 B2 11/2010 Eddison
8,028,763 B2 10/2011 Mackenzie
8,936,009 B2 1/2015 Hu
9,611,697 B2 4/2017 Radford et al.
(Continued)

FOREIGN PATENT DOCUMENTS

| | | |
|---|---|---|
| CN | 106285483 | 1/2017 |
| WO | WO 9421889 | 9/1994 |

OTHER PUBLICATIONS

PCT International Search Report and Written Opinion in International Appln. No. PCT/US2021/049388, dated Dec. 7, 2021, 16 pages.

*Primary Examiner* — D. Andrews
*Assistant Examiner* — Ronald R Runyan
(74) *Attorney, Agent, or Firm* — Fish & Richardson P.C.

(57) ABSTRACT

An apparatus is positioned within a wellbore in a subterranean formation. The apparatus includes a housing, a guide shaft, a follower, multiple underreamer blades, and a hydraulic chamber. The housing defines a track including multiple catch points. The guide shaft is disposed within the housing. The follower protrudes radially outward form the guide shaft and is received by the track. The follower and the track are cooperatively configured to restrict movement of the guide shaft relative to the housing. A rate of flow to the guide shaft is adjusted to adjust a relative position of the guide shaft with respect to the housing until the follower is located at one of the catch points. A pressure within the hydraulic chamber is adjusted to adjust a level of radially outward protrusion of the underreamer blades. The underreamer blades are rotated to cut into the subterranean formation.

15 Claims, 9 Drawing Sheets

(56) References Cited

U.S. PATENT DOCUMENTS

| | | | | |
|---|---|---|---|---|
| 2009/0032308 | A1* | 2/2009 | Eddison | E21B 10/322 175/267 |
| 2014/0262211 | A1 | 9/2014 | Xu et al. | |
| 2017/0159365 | A1* | 6/2017 | Solem | E21B 10/325 |

* cited by examiner

RETRACTED POSITION

INTERMEDIATE POSITION 1

INTERMEDIATE POSITION 2

EXTENDED POSITION

WELLBORE UNDERREAMING

TECHNICAL FIELD

This disclosure relates to underreaming of wellbores.

BACKGROUND

Well drilling is the process of drilling a wellbore in a subterranean formation. In some cases, the well is a production well for extraction of a natural resource such as ground water, brine, natural gas, or petroleum. In some cases, the well is an injection well for injection of a fluid from the surface into the subterranean formation. In some instances, it may be desirable to enlarge a wellbore, for example, below an existing casing or restriction during well drilling. The process of enlarging a wellbore is also known as underreaming.

SUMMARY

This disclosure describes technologies relating to underreaming of wellbores. The subject matter described in this disclosure can be implemented in particular implementations, so as to realize one or more of the following advantages. The underreaming diameter can be adjusted to a desired diameter downhole without requiring the system to be pulled out of hole. The system can repeat underreaming operations at various depths in a single run as desired. The system includes a controller that is configured to adjust a drilling hole diameter according to downhole pressure and geo-mechanical conditions to optimize drilling. The controller can utilize geo-mechanical data, for example, obtained from offset wells while also taking into consideration real-time data logs deployed on a single run to automatically activate the underreamer blades in an optimized configuration.

Certain aspects of the subject matter described can be implemented as a system. The system includes a housing, a guide shaft, a follower, multiple underreamer blades, a hydraulic chamber, a guide cone, and a controller. The housing defines a track including multiple catch points. The guide shaft is disposed within an inner bore of the housing. The follower protrudes radially outward from the guide shaft. The follower is received by the track of the housing. The follower and the track are cooperatively configured to restrict movement of the guide shaft relative to the housing to movement defined by the follower traveling along the track. Each underreamer blade is configured to rotate and cut into the subterranean formation. The hydraulic chamber is disposed within the housing and coupled to the underreamer blades. The guide cone is coupled to the hydraulic chamber. The guide cone is configured to adjust a level of radially outward protrusion of the underreamer blades based on a pressure within the hydraulic chamber. Each configuration of the follower being located at one of the catch points of the track corresponds to a different pressure within the hydraulic chamber and, in turn, a different level of radially outward protrusion of the underreamer blades. The controller is communicatively coupled to the hydraulic chamber and the underreamer blades. The controller is configured to detect whether the follower is located at any one of the catch points of the track. The controller is configured to, after detecting that the follower is located at one of the catch points of the track, transmit a pressurization signal to the hydraulic chamber to adjust the pressure within the hydraulic chamber to a pressure level corresponding to the respective catch point at which the follower is located. The controller is configured to, after the pressure within the hydraulic chamber has reached the pressure level, transmit an underreaming signal to the underreamer blades to rotate the underreamer blades, thereby cutting into the subterranean formation.

This, and other aspects, can include one or more of the following features.

In some implementations, the underreamer blades are configured to move between a retracted position and an extended position with multiple intermediate positions between the retracted position and the extended position. In some implementations, the extended position corresponds to the largest diameter of radially outward protrusion of the underreamer blades. In some implementations, each of the retracted position, the intermediate positions, and the extended position corresponds to a different catch point of the track.

In some implementations, the system includes a spring configured to bias the underreamer blades to the retracted position. In some implementations, the hydraulic chamber is configured to generate sufficient pressure to resist the bias of the spring to move the underreamer blades from the retracted position.

In some implementations, the underreamer blades are located between the spring and the guide cone.

In some implementations, the track spans an entire circumference of an inner circumferential wall of the housing.

Certain aspects of the subject matter described can be implemented as a method. An apparatus is positioned within a wellbore in a subterranean formation. The apparatus includes a housing, a guide shaft, a follower, multiple underreamer blades, and a hydraulic chamber. The housing defines a track including multiple catch points. The guide shaft is disposed within the housing. The follower protrudes radially outward from the guide shaft and is received by the track of the housing. The follower and the track are cooperatively configured to restrict movement of the guide shaft relative to the housing to movement defined by the follower traveling along the track. The hydraulic chamber is disposed within the housing and coupled to the underreamer blades. A rate of flow to the guide shaft is adjusted to adjust a relative position of the guide shaft with respect to the housing until the follower is located at one of the catch points of the track. In response to the follower being located at the catch of the track, a pressure within the hydraulic chamber is adjusted to adjust a level of radially outward protrusion of the underreamer blades. Each underreamer blade is rotated to cut into the subterranean formation.

This, and other aspects, can include one or more of the following features.

In some implementations, the underreamer blades are configured to move between a retracted position and an extended position with multiple intermediate positions between the retracted position and the extended position. In some implementations, the extended position corresponds to the largest diameter of radially outward protrusion of the underreamer blades. In some implementations, each of the retracted position, the intermediate positions, and the extended position corresponds to a different catch point of the track.

In some implementations, the underreamer blades are adjusted from the retracted to any of the intermediate positions or the extended position.

In some implementations, the apparatus includes a spring configured to bias the underreamer blades to the retracted position. In some implementations, adjusting the pressure within the hydraulic chamber includes generating sufficient pressure in the hydraulic chamber to resist the bias of the spring to move the underreamer blades from the retracted position to any one of the intermediate positions or the extended position.

In some implementations, the apparatus includes a guide cone coupled to the hydraulic chamber. In some implementations, the guide cone is in physical contact with the underreamer blades. In some implementations, the underreamer blades are located between the spring and the guide cone. In some implementations, adjusting the pressure within the hydraulic chamber results in adjusting a position of the guide cone to adjust the level of radially outward protrusion of the underreamer blades.

In some implementations, the track spans an entire circumference of an inner circumferential wall of the housing.

Certain aspects of the subject matter described can be implemented as a computer-implemented method. The computer-implemented method includes detecting whether a follower protruding from a guide shaft is located at any one catch point of multiple catch points of a track that is defined by a housing. After detecting that the follower is located at one of the catch points of the track, a pressurization signal is transmitted to a hydraulic chamber disposed within the housing and coupled to multiple underreamer blades to adjust a pressure within the hydraulic chamber to a pressure level that corresponds to the respective catch point at which the follower is located, thereby adjusting a level of radially outward protrusion of the underreamer blades. After the pressure within the hydraulic chamber has reached the pressure level, the computer-implemented method includes detecting whether each underreamer blade is in contact with a wall of a subterranean formation. After detecting that each underreamer blade is in contact with the wall of the subterranean formation, an underreaming signal is transmitted to the underreamer blades to rotate each underreamer blade, thereby cutting into the subterranean formation.

This, and other aspects, can include one or more of the following features.

In some implementations, transmitting the pressurization signal results in adjusting the underreamer blades to a first level of radially outward protrusion. In some implementations, after detecting that the follower is located at a different one of the catch points of the track, a second pressurization signal is transmitted to the hydraulic chamber to adjust the pressure within the hydraulic chamber to a second pressure level that corresponds to the respective catch point at which the follower is located, thereby adjusting the underreamer blades to a second level of radially outward protrusion. In some implementations, after the pressure within the hydraulic chamber has reached the second pressure level, the computer-implemented method includes detecting whether each underreamer blade is in contact with the wall of the subterranean formation. In some implementations, after detecting that each underreamer blade is in contact with the wall of the subterranean formation, a second underreaming signal is transmitted to the underreamer blades to rotate each underreamer blade, thereby cutting into the subterranean formation.

In some implementations, an inner diameter of a wellbore in the subterranean formation is detected. In some implementations, the detected inner diameter of the wellbore is compared with a target inner diameter. In some implementations, a pressure level within the hydraulic chamber that corresponds to a level of radially outward protrusion of the underreamer blades that matches the target inner diameter is determined.

In some implementations, a second pressurization signal is transmitted to the hydraulic chamber to adjust the pressure within the hydraulic chamber to the determined pressure level, thereby adjusting the underreamer blades to the level of radially outward protrusion that matches the target inner diameter. In some implementations, after the pressure within the hydraulic chamber has reached the determined pressure level, the computer-implemented method includes detecting whether each underreamer blade is in contact with the wall of the subterranean formation. In some implementations, after detecting that each underreamer blade is in contact with the wall of the subterranean formation, a second underreaming signal is transmitted to the underreamer blades to rotate each underreamer blade, thereby cutting into the subterranean formation.

The details of one or more implementations of the subject matter of this disclosure are set forth in the accompanying drawings and the description. Other features, aspects, and advantages of the subject matter will become apparent from the description, the drawings, and the claims.

DESCRIPTION OF DRAWINGS

FIGS. 2E-1, 2E-2, 2E-3, and 2E-4 are schematic diagrams that illustrate various configurations of underreamer blades of the system of FIG. 2A.

FIG. 3 is a flow chart of an example method that can be implemented by the system of FIG. 2A.

FIG. 4 is a flow chart of an example method 400 that can be implemented by the controller of the system of FIG. 2A.

DETAILED DESCRIPTION

Figure 1:
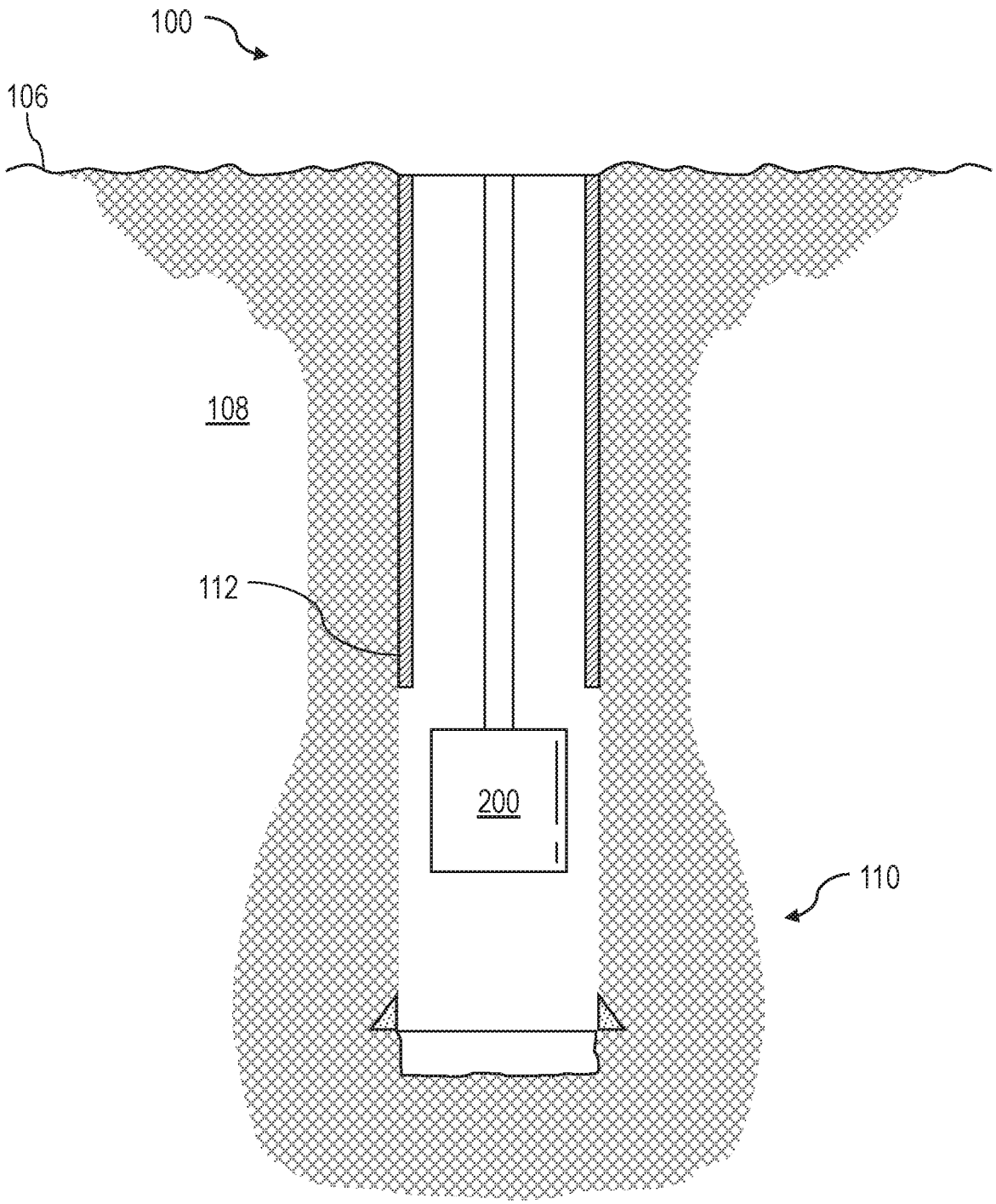
FIG. 1 is a schematic diagram of an example well.

This disclosure describes underreaming of wellbores. FIG. 1 depicts an example well 100 constructed in accordance with the concepts herein. The well 100 extends from the surface 106 through the Earth 108 to one more subterranean zones of interest 110 (one shown). The well 100 enables access to the subterranean zones of interest 110 to allow recovery (that is, production) of fluids to the surface 106 (represented by flow arrows in FIG. 1) and, in some implementations, additionally or alternatively allows fluids to be placed in the Earth 108. In some implementations, the subterranean zone 110 is a formation within the Earth 108 defining a reservoir, but in other instances, the zone 110 can be multiple formations or a portion of a formation. The subterranean zone can include, for example, a formation, a portion of a formation, or multiple formations in a hydrocarbon-bearing reservoir from which recovery operations can be practiced to recover trapped hydrocarbons. In some implementations, the subterranean zone includes an underground formation of naturally fractured or porous rock containing hydrocarbons (for example, oil, gas, or both). In some implementations, the well can intersect other suitable types of formations, including reservoirs that are not naturally fractured. For simplicity's sake, the well 100 is shown as a vertical well, but in other instances, the well 100 can be a deviated well with a wellbore deviated from vertical (for example, horizontal or slanted), the well 100 can include multiple bores forming a multilateral well (that is, a well having multiple lateral wells branching off another well or wells), or both.

In some implementations, the well 100 is a gas well that is used in producing hydrocarbon gas (such as natural gas) from the subterranean zones of interest 110 to the surface 106. While termed a "gas well," the well need not produce only dry gas, and may incidentally or in much smaller quantities, produce liquid including oil, water, or both. In some implementations, the well 100 is an oil well that is used in producing hydrocarbon liquid (such as crude oil) from the subterranean zones of interest 110 to the surface 106. While termed an "oil well," the well not need produce only hydrocarbon liquid, and may incidentally or in much smaller quantities, produce gas, water, or both. In some implementations, the production from the well 100 can be multiphase in any ratio. In some implementations, the production from the well 100 can produce mostly or entirely liquid at certain times and mostly or entirely gas at other times. For example, in certain types of wells it is common to produce water for a period of time to gain access to the gas in the subterranean zone. The concepts herein, though, are not limited in applicability to gas wells, oil wells, or even production wells, and could be used in wells for producing other gas or liquid resources or could be used in injection wells, disposal wells, or other types of wells used in placing fluids into the Earth.

The wellbore of the well 100 is typically, although not necessarily, cylindrical. All or a portion of the wellbore is lined with a tubing, such as casing 112. The casing 112 connects with a wellhead at the surface 106 and extends downhole into the wellbore. The casing 112 operates to isolate the bore of the well 100, defined in the cased portion of the well 100 by the inner bore 116 of the casing 112, from the surrounding Earth 108. The casing 112 can be formed of a single continuous tubing or multiple lengths of tubing joined (for example, threadedly) end-to-end. In some implementations, the casing 112 is omitted or ceases in the region of the subterranean zone of interest 110. This portion of the well 100 without casing is often referred to as "open hole."

The wellhead defines an attachment point for other equipment to be attached to the well 100. For example, FIG. 1 shows well 100 being produced with a Christmas tree attached to the wellhead. The Christmas tree includes valves used to regulate flow into or out of the well 100. The well 100 also includes a system 200 residing in the wellbore, for example, at a depth that is nearer to subterranean zone 110 than the surface 106. The system 200 is of a type configured in size and robust construction for installation within a well 100.

In particular, casing 112 is commercially produced in a number of common sizes specified by the American Petroleum Institute (the "API"), including 4½, 5, 5½, 6, 6⅝, 7, 7⅝, 7¾, 8⅝, 8¾, 9⅝, 9¾, 9⅞, 10¾, 11¾, 11⅞, 13⅜, 13½, 13⅝, 16, 18⅝, and 20 inches, and the API specifies internal diameters for each casing size. The system 200 can be configured to fit in, and (as discussed in more detail below) in certain instances, seal to the inner diameter of one of the specified API casing sizes. Of course, the system 200 can be made to fit in and, in certain instances, seal to other sizes of casing or tubing or otherwise seal to a wall of the well 100.

Additionally, the construction of the components of the system 200 are configured to withstand the impacts, scraping, and other physical challenges the system 200 will encounter while being passed hundreds of feet/meters or even multiple miles/kilometers into and out of the well 100. For example, the system 200 can be disposed in the well 100 at a depth of up to 20,000 feet (6,096 meters). Beyond just a rugged exterior, this encompasses having certain portions of any electronics being ruggedized to be shock resistant and remain fluid tight during such physical challenges and during operation. Additionally, the system 200 is configured to withstand and operate for extended periods of time (for example, multiple weeks, months or years) at the pressures and temperatures experienced in the well 100, which temperatures can exceed 400 degrees Fahrenheit (° F.)/205 degrees Celsius (° C.) and pressures over 2,000 pounds per square inch gauge (psig), and while submerged in the well fluids (gas, water, or oil as examples). Finally, the system 200 can be configured to interface with one or more of the common deployment systems, such as jointed tubing (that is, lengths of tubing joined end-to-end), a sucker rod, coiled tubing (that is, not-jointed tubing, but rather a continuous, unbroken and flexible tubing formed as a single piece of material), or wireline with an electrical conductor (that is, a monofilament or multifilament wire rope with one or more electrical conductors, sometimes called e-line) and thus have a corresponding connector (for example, a jointed tubing connector, coiled tubing connector, or wireline connector).

In some implementations, the system 200 can be implemented to alter characteristics of a wellbore by a mechanical intervention at the source. Alternatively, or in addition to any of the other implementations described in this specification, the system 200 can be implemented in a direct well-casing deployment.

The system 200 can operate in a variety of downhole conditions of the well 100. For example, the initial pressure within the well 100 can vary based on the type of well, depth of the well 100, and production flow from the perforations into the well 100. In some examples, the pressure in the well 100 proximate a bottomhole location is sub-atmospheric, where the pressure in the well 100 is at or below about 14.7 pounds per square inch absolute (psia), or about 101.3 kiloPascal (kPa). The system 200 can operate in sub-atmospheric well pressures, for example, at well pressure between 2 psia (13.8 kPa) and 14.7 psia (101.3 kPa). In some examples, the pressure in the well 100 proximate a bottomhole location is much higher than atmospheric, where the pressure in the well 100 is above about 14.7 pounds per square inch absolute (psia), or about 101.3 kiloPascal (kPa). The system 200 can operate in above atmospheric well pressures, for example, at well pressure between 14.7 psia (101.3 kPa) and 5,000 psia (34,474 kPa).

Figure 2A:
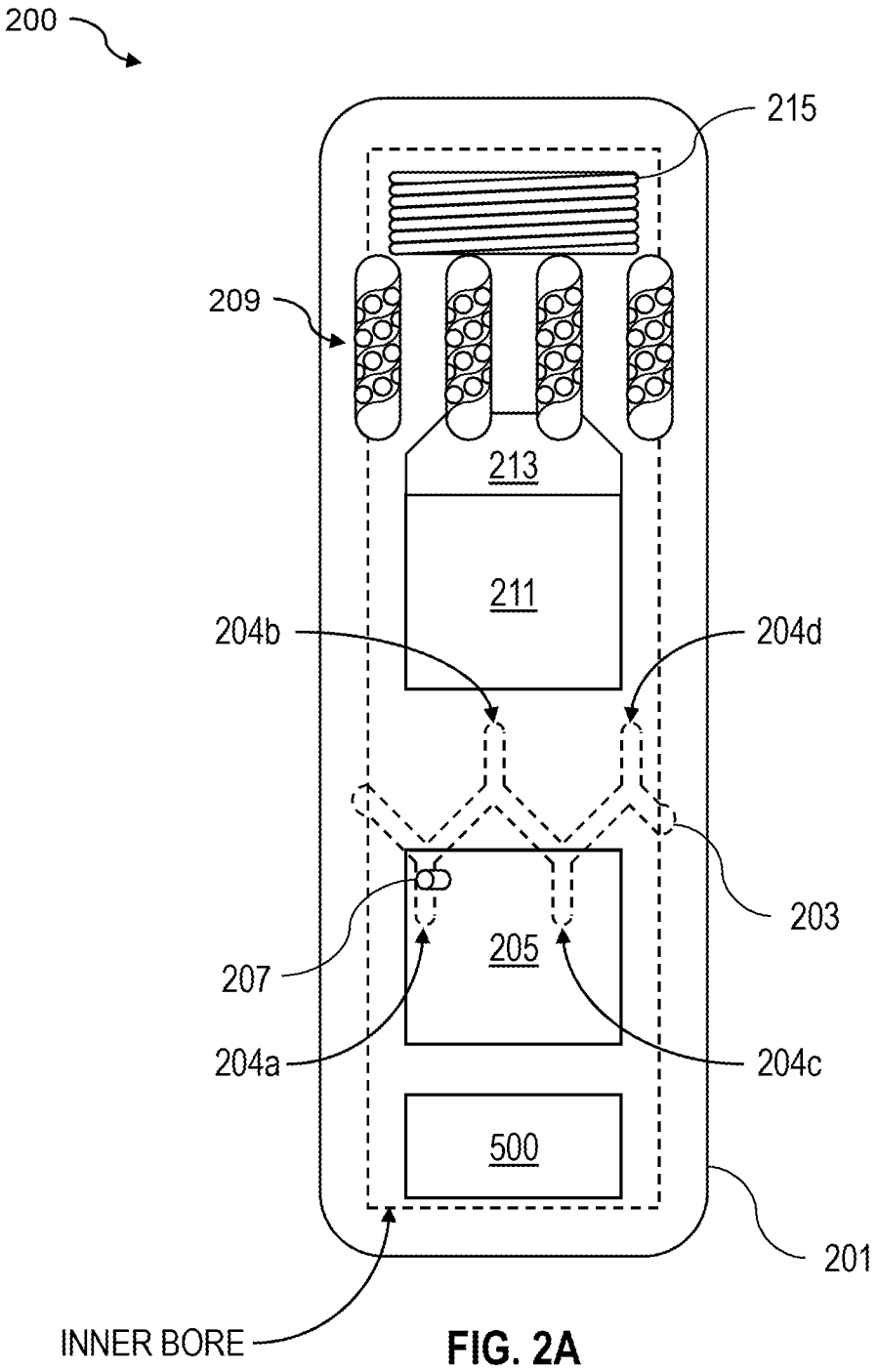
FIG. 2A is a schematic diagram of an example system that can be implemented in the well of FIG. 1.

FIG. 2A is a schematic diagram of an example system 200 that can be disposed within a wellbore (for example, in the well 100) to conduct an underreaming operation. The system 200 includes a housing 201, a guide shaft 205, a follower 207, multiple underreamer blades 209, a hydraulic chamber 211, a guide cone 213, and a controller 500. The system 200 can be positioned within a wellbore at a depth at which enlarging of the wellbore is desired. The system 200 can then be used to underream, thereby enlarging the wellbore. Typically, the portion of the wellbore that is being enlarged is uncased (that is, not lined with a casing or other tubular).

Figure 2B:
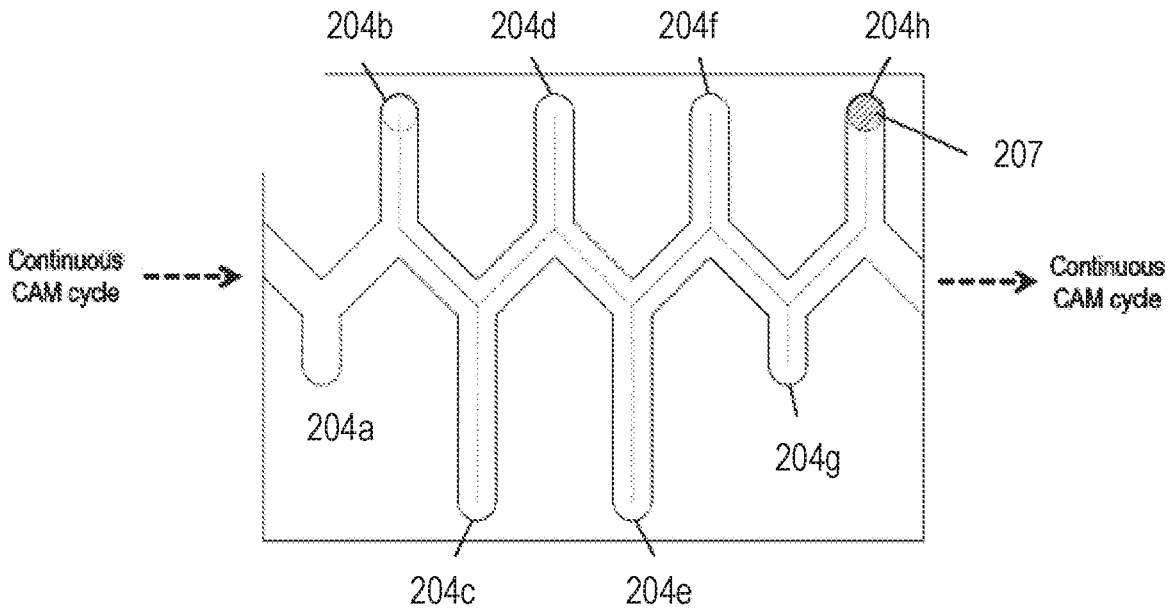
FIG. 2B is a schematic diagram showing a portion of the system of FIG. 2A.

The housing 201 defines a track 203 that includes multiple catch points 204 (individual catch points are labeled with a letter following '204'). In some implementations, the track 203 is a groove formed in the housing 201. In some implementations, the track 203 spans an entire circumference of an inner circumferential wall of the housing 201. An example of the track 203 is also shown in FIG. 2B.

The guide shaft 205 is disposed within an inner bore of the housing 201, such that the housing 201 surrounds at least a portion of the guide shaft 205. In some implementations, the guide shaft 205 is configured to receive a fluid and to adjust its relative longitudinal position with respect to the housing 201 based on an adjustment in flow rate of the received fluid. For example, flowing a fluid to the guide shaft 205 at an increased flow rate can cause the guide shaft 205 to move downhole relative to the housing 201 or uphole relative to the housing 201. For example, flowing a fluid to the guide shaft 205 at a decreased flow rate can cause the guide shaft 205 to move uphole relative to the housing 201 or downhole relative to the housing 201. In some implementations, the fluid flowed to the guide shaft 205 is drilling fluid. The fluid can be flowed, for example, from a mud tank to the guide shaft 205 and be recirculated to the surface through an annulus in the well 100.

The follower 207 protrudes radially outward from the guide shaft 205. For example, the follower 207 is a pin that protrudes from the guide shaft 205. The follower 207 is configured to be received by the track 203 of the housing 201. In some implementations, the lateral width of the track 203 corresponds to an outer diameter of the follower 207. The follower 207 and track 203 are cooperatively configured to restrict movement of the guide shaft 205 relative to the housing 201 to movement defined by the follower 207 traveling along the track 203. By adjusting the rate of fluid flow to the guide shaft 205, an operator can control movement of the follower 207 along the track 203. For example, the operator can control adjustment of the rate of fluid flow to the guide shaft 205 to cause the follower 207 to move to a desired catch point 204 along the track 203.

Each of the underreamer blades 209 are configured to rotate to cut into a subterranean formation (for example, a wall of the subterranean zone 110). In some implementations, the underreamer blades 209 are configured to move between a retracted position and an extended position with multiple intermediate positions between the retracted position and the extended position. The extended position corresponds to the largest diameter of radially outward protrusion of the underreamer blades 209. In some implementations, each of the retracted position, the intermediate positions, and the extended position correspond to a different catch point 204 of the track 203. In some implementations, the system 200 includes three underreamer blades 209. In some implementations, the system 200 includes four underreamer blades 209. In some implementations, the system 200 includes more than four underreamer blades 209. The shape of the underreamer blades 209 can depend on various factors, such as desired range of underreaming diameters and rock formation composition. In some implementations, at least a portion of each underreamer blade 209 is made of a metal alloy. In some implementations, at least a portion of each underreamer blade 209 is made of polycrystalline diamond compact (PDC). For example, each underreamer blade 209 can include a PDC cutter embedded in a metal alloy. As the underreamer blades 209 rotate, they cut into the subterranean formation to increase a hole diameter.

The hydraulic chamber 211 is disposed within the housing 201 and coupled to the underreamer blades 209. The hydraulic chamber 211 is configured to generate pressure. For example, the hydraulic chamber 211 is a hydraulic power unit. In some implementations, the hydraulic chamber 211 includes a turbine that generates power which can be used to generate pressure within the hydraulic chamber 211.

The guide cone 213 is coupled to the hydraulic chamber 211. In some implementations, the guide cone 213 is in physical contact with the underreamer blades 209. The guide cone 213 is configured to adjust a level of radially outward protrusion of the underreamer blades 209 based on a pressure within the hydraulic chamber. For example, the pressure generated by the hydraulic chamber causes the guide cone 213 to push the underreamer blades 209 to adjust the level of radially outward protrusion of the underreamer blades 209 from the housing 201.

The controller 500 is communicatively coupled to the hydraulic chamber 211 and the underreamer blades 209. The controller 500 is configured to detect whether the follower 207 is located at any one of the catch points 204 of the track 203. Each of the catch points 204 corresponds to a different pre-determined pressure level in the hydraulic chamber 211. After detecting that the follower 207 is located at one of the catch points 204, the controller 500 is configured to transmit a pressurization signal to the hydraulic chamber 211 to adjust the pressure within the hydraulic chamber 211 to match the pre-determined pressure level corresponding to the respective catch point 204 at which the follower 207 is located. Adjusting the pressure within the hydraulic chamber 211 causes adjustment of the level of radially outward protrusion of the underreamer blades 209. After the pressure within the hydraulic chamber 211 has reached the pre-determined pressure level, the controller 500 is configured to transmit an underreaming signal to the underreamer blades 209, which causes the underreamer blades 209 to rotate, thereby cutting into the subterranean formation to enlarge the wellbore. In some implementations, after the pressure within the hydraulic chamber 211 has reached the pre-determined pressure level, the controller 500 is configured to detect whether each underreamer blade 209 is in contact with the wall of the subterranean formation. In such implementations, after detecting that each underreamer blade 209 is in contact with the wall of the subterranean formation, the controller 500 is configured to transmit the underreaming signal to the underreamer blades 209, which causes the underreamer blades 209 to rotate, thereby cutting into the subterranean formation to enlarge the wellbore.

In some implementations, the controller 500 is configured to detect an inner diameter of a wellbore in the subterranean formation. For example, the controller 500 can measure an inner diameter of the wellbore that was originally drilled. In some implementations, the controller 500 is configured to compare the detected inner diameter of the wellbore with a target inner diameter. In cases where the detected inner diameter is smaller than the target inner diameter, the controller 500 can determine a pressure level within the hydraulic chamber 211 that corresponds to a level of radially outward protrusion of the underreamer blades 209 that allows for the underreamer blades 209 to enlarge the wellbore to the target inner diameter.

In some implementations, the controller 500 utilizes and/or analyzes off-set data obtained from the subterranean formation. Some examples of off-set data include well logs (such as from measurements-while-drilling (MWD) or logging while drilling (LWD)), geo-mechanical studies, history of tight spots in the subterranean zone. The off-set data can be obtained, for example, by downhole sensors from multiple wells. In some implementations, the controller 500 utilizes and/or analyzes off-set data to determine an appropriate underreaming diameter.

In some implementations, the system 200 includes a spring 215 that is configured to bias the underreamer blades 209 to the retracted position. In such implementations, the hydraulic chamber 211 is configured to generate sufficient pressure to resist the bias of the spring 215 to move the underreamer blades 209 from the retracted position to any of the intermediate positions or the extended position.

Figure 2C:
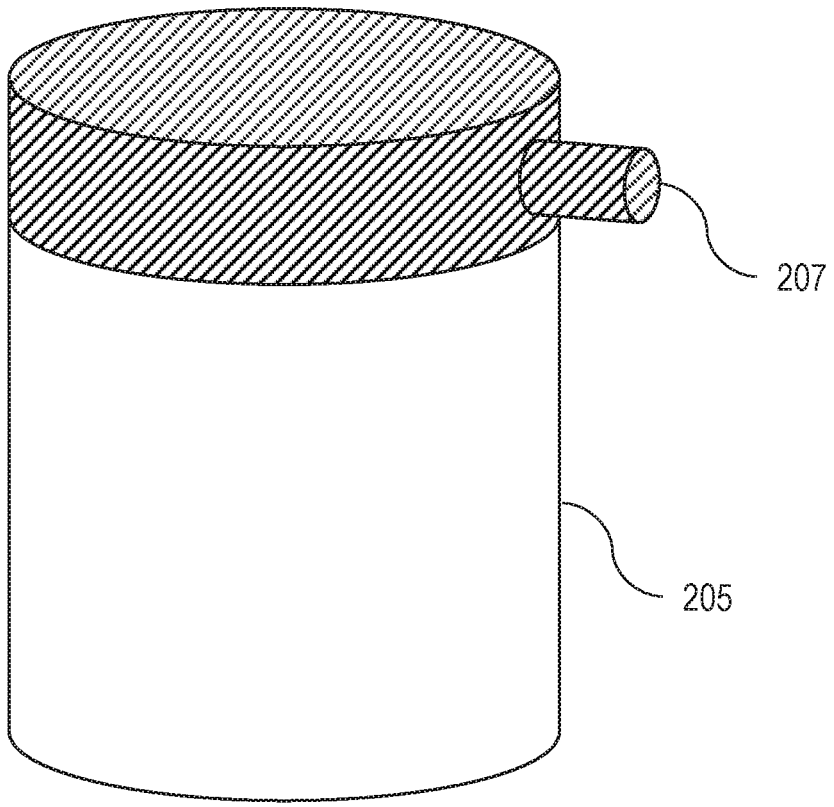
FIG. 2C is a schematic diagram of an example guide shaft that can be implemented in the system of FIG. 2A.
Figure 2D:
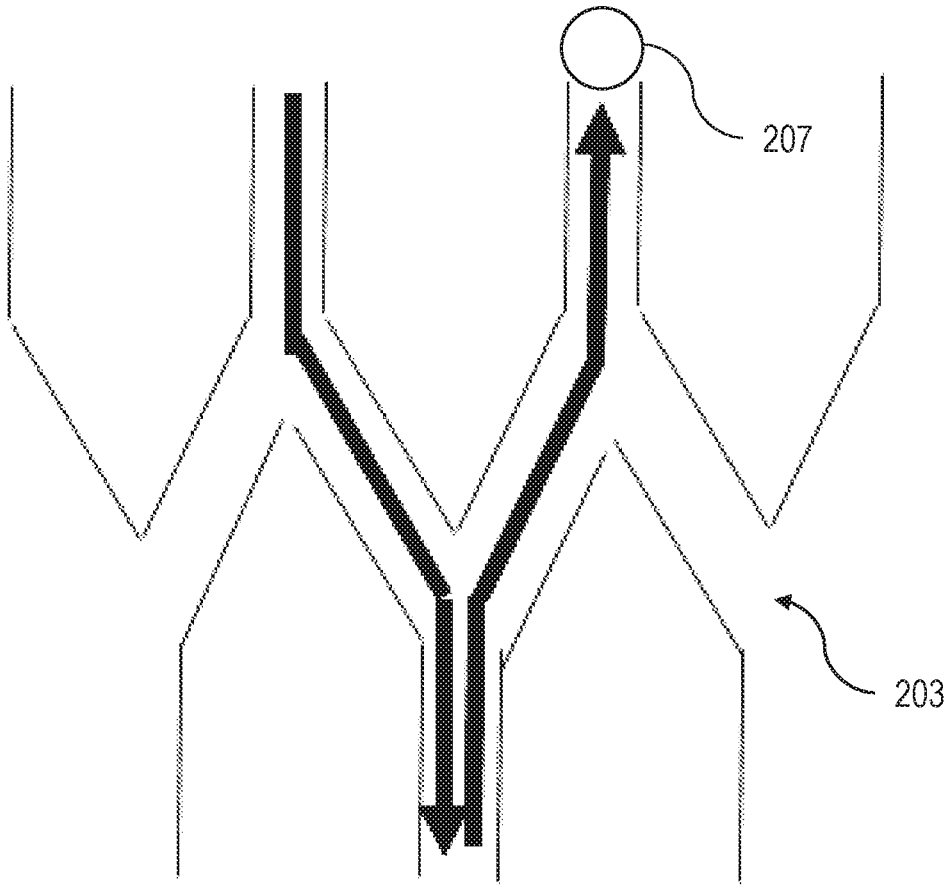
FIG. 2D is a schematic diagram that illustrates an example progression movement of components of the system of FIG. 2A.

FIG. 2B is a schematic diagram showing a portion of an example inner circumferential wall of the housing 201. A portion of an example track 203 with multiple catch points (204*a*, 204*b*, 204*c*, 204*d*, 204*e*, 204*f*, 204*g*, 204*h*) is shown in FIG. 2B. In this particular instance shown in FIG. 2B, the follower 207 is received by the track 203 and is located at catch point 204*h*. In the implementation shown in FIG. 2B, catch points 204*b*, 204*d*, 204*f*, and 204*h* can be considered "standby" catch points, catch points 204*c* and 204*e* can be considered "bypass" catch points, and catch point 204*g* can be considered a "selective release" catch point. Each of the standby catch points can correlate to a different underreaming diameter determined by the level of radially outward protrusion of the underreamer blades 209. The controller 500 can detect the position of the follower 207 on the track 203 and adjust the level of radially outward protrusion of the underreamer blades 209 based on the detected position of the follower 207. The bypass catch points are intermediate points between neighboring standby catch points which can allow for better control and accurate detection of the position of the follower 207 by the controller 500. In some implementations, the selective release catch point can be used as a "reset" point at which the underreamer blades 209 return to one of the previous diameters, for example, a retracted position. FIG. 2C is a schematic diagram of an example guide shaft 205. An example of the follower 207 protruding radially outward from the guide shaft 205 is also shown in FIG. 2C. FIG. 2D is a schematic diagram that illustrates an example progression of the guide shaft 205 moving relative to the housing 201 via travel of the follower 207 along the track 203.

Figures 1, 2E:
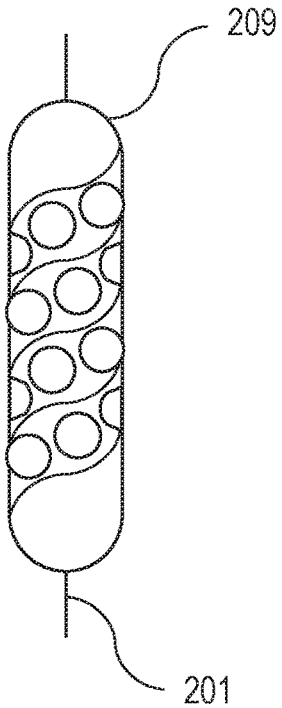
Figures 2, 2E:
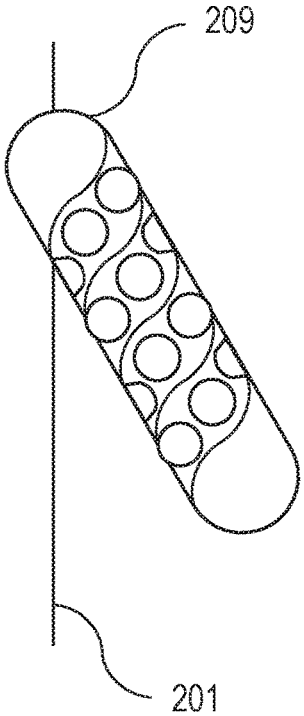
Figures 2, 2E, 3:
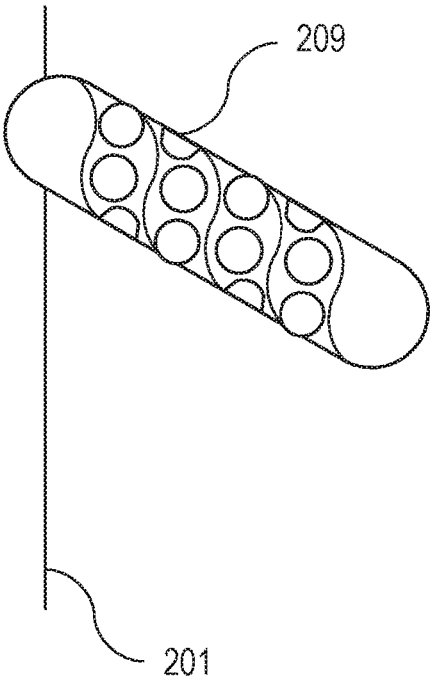

FIGS. 2E-1, 2E-2, 2E-3, and 2E-4 are schematic diagrams that illustrate various levels of radially outward protrusion of one of the underreamer blades 209. FIG. 2E-1 shows the underreamer blade 209 in a retracted position. FIG. 2E-2 shows the underreamer blade 209 in a first intermediate position. FIG. 2E-3 shows the underreamer blade 209 in a second intermediate position. In the second intermediate position, the underreamer blades 209 can form a larger wellbore in comparison to the first intermediate position. FIG. 2E-4 shows the underreamer blade 209 in an extended position. In the extended position, the underreamer blades 209 can form their maximum diameter wellbore. Although two intermediate positions are shown in FIGS. 2E-2 and 2E-3, in some implementations, the underreamer blades 209 are configured to have additional or fewer intermediate positions between the retracted position and the extended position (for example, one intermediate position, three intermediate positions, or more than three intermediate positions).

FIG. 3 is a flow chart of an example method 300 that can, for example, be implemented by the system 200 in the well 100. At step 302, an apparatus (for example, the system 200) is positioned within a wellbore in a subterranean formation (for example, the wellbore of the well 100). As described previously, the system 200 includes the housing 201, the guide shaft 205, the follower 207, the underreamer blades 209, and the hydraulic chamber 211. The housing 201 defines the track 203 that includes multiple catch points 204. The guide shaft 205 is disposed within the housing 201. The follower 207 protrudes radially outward from the guide shaft 205 and is received by the track 203 of the housing 201. The follower 207 and the track 203 are cooperatively configured to restrict movement of the guide shaft 205 relative to the housing 201 to movement defined by the follower 207 traveling along the track 203. The hydraulic chamber 211 is disposed within the housing 201 and coupled to the underreamer blades 209.

At step 304, a rate of flow to the guide shaft 205 is adjusted to adjust a relative position of the guide shaft 205 with respect to the housing 201 until the follower 207 is located at one of the catch points 204 of the track 203. In some implementations, step 304 is repeated until the follower 207 is located at a specific, desired one of the catch points 204 of the track 203.

In response to the follower 207 being located at the catch point 204 of the track 203 at step 304, a pressure within the hydraulic chamber 211 is adjusted to adjust a level of radially outward protrusion of the underreamer blades 209 at step 306. As described previously, in some implementations, the underreamer blades 209 are configured to move between a retracted position and an extended position with multiple intermediate positions between the retracted position and the extended position. The extended position corresponds to the largest diameter of radially outward protrusion of the underreamer blades 209, which in turn corresponds to the largest diameter to which the underreamer blades 209 can underream the wellbore. Each of the retracted position, the intermediate positions, and the extended position corresponds to a different catch point 204 of the track 203. In some implementations, the underreamer blades 209 are adjusted from the retracted position to any one of the intermediate positions or the extended position. In some implementations, the underreamer blades 209 are adjusted from any one of the intermediate positions to the extended position. In some implementations, the underreamer blades 209 are adjusted from any one of the intermediate positions to the retracted position. In some implementations, the underreamer blades 209 are adjusted from any one of the intermediate positions to another one of the intermediate positions.

In some implementations, the apparatus (system 200) includes the spring 215 that is configured to bias the underreamer blades 209 to the retracted position. In some implementations, adjusting the pressure within the hydraulic chamber 211 at step 306 includes generating sufficient pressure in the hydraulic chamber 211 to resist the bias of the spring 215 to move the underreamer blades 209 from the retracted position to any one of the intermediate positions or the extended position.

In some implementations, the apparatus (system 200) includes the guide cone 213 that is coupled to the hydraulic chamber 211 and in physical contact with the underreamer blades 209. In some implementations, the underreamer blades 209 are located between the spring 215 and the guide cone 213. In some implementations, adjusting the pressure within the hydraulic chamber 211 at step 306 results in adjusting a position of the guide cone 213 to adjust the level of radially outward protrusion of the underreamer blades 209.

At step 308, each underreamer blade 209 is rotated to cut into the subterranean formation. Some of the aforementioned steps of method 300 can be initiated by the controller 500. For example, the controller 500 can transmit a pressurization signal to the hydraulic chamber 211 to initiate step 304. For example, the controller 500 can transmit an underreaming signal to the underreamer blades 209 to initiate step 308.

Figures 2, 2E, 3, 4:
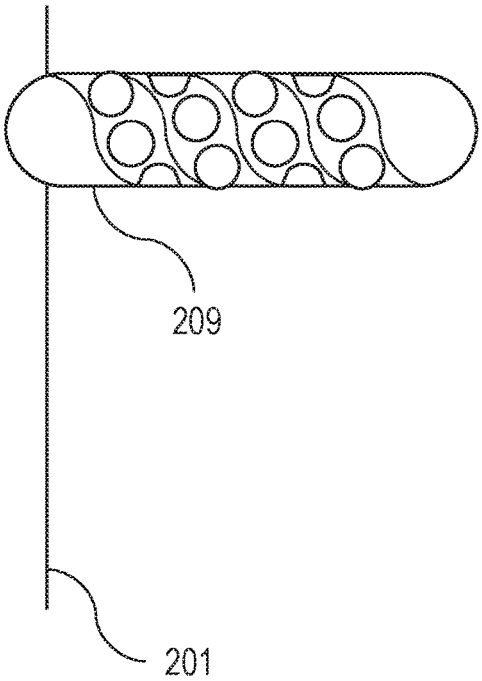
Figure 3:
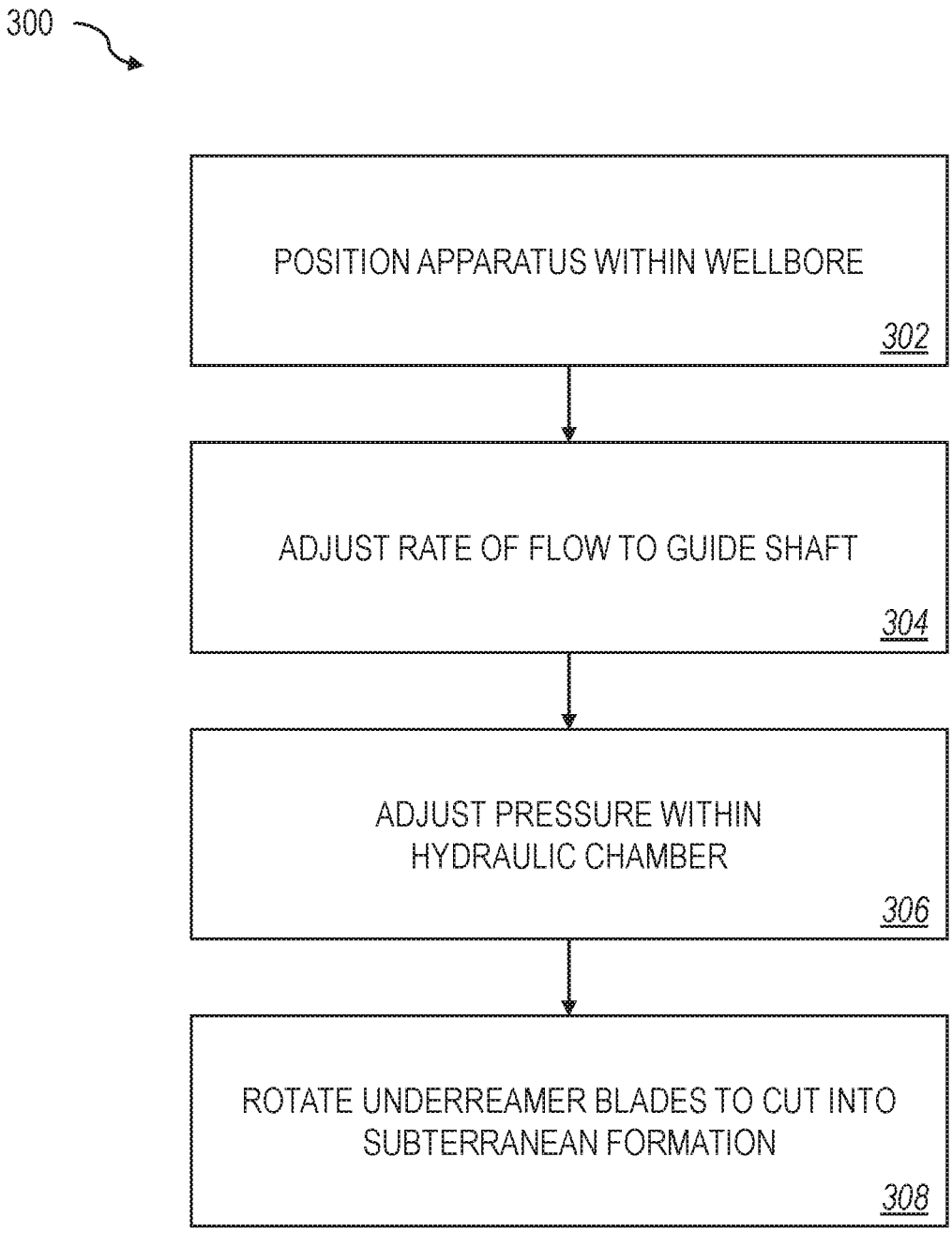
Figure 4:
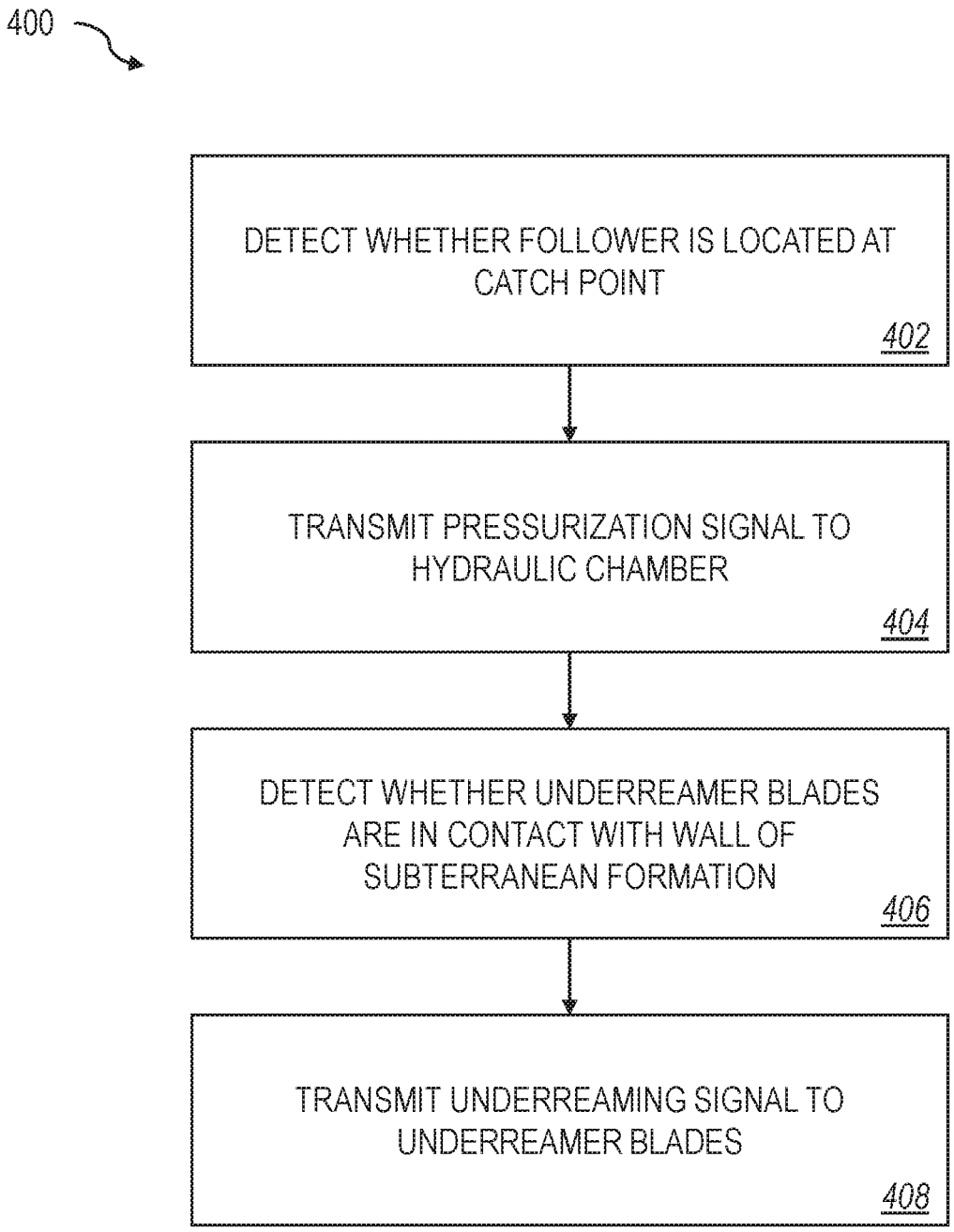

FIG. 4 is a flow chart of an example method 400 that can, for example, be implemented by the controller 500 of the system 200. At step 402, the controller 500 detects whether a follower (for example, the follower 207 protruding from the guide shaft 205) is located at any of the catch points of a track (for example, the catch points 204 of the track 203 that is defined by the housing 201).

After detecting that the follower 207 is located at one of the catch points 204 of the track 203 at step 402, the controller 500 transmits, at step 404, a pressurization signal to a hydraulic chamber (for example, the hydraulic chamber 211 disposed within the housing 201 and coupled to the underreamer blades 209) to adjust a pressure within the hydraulic chamber 211 to a pressure level that corresponds to the respective catch point 204 at which the follower 207 is located, thereby adjusting a level of radially outward protrusion of the underreamer blades 209.

After the pressure within the hydraulic chamber 211 has reached the pressure level, the controller 500 detects, at step 406, whether each underreamer blade 209 is in contact with a wall of a subterranean formation (for example, the wall of the wellbore in the subterranean formation).

After detecting that each underreamer blade 209 is in contact with the wall of the subterranean formation at step 406, the controller 500 transmits, at step 408, an underreaming signal to the underreamer blades 209 to rotate each underreamer blade, thereby cutting into the subterranean formation.

In some implementations, method 400 is repeated after the follower has moved to another one of the catch points (different from the catch point detected at step 402). In such implementations, the pressure within the hydraulic chamber 211 is re-adjusted to a second pressure level (different from the first implementation of step 404) that corresponds to the respective catch point 204 at which the follower 207 is located, thereby re-adjusting the underreamer blades 209 to a second level of radially outward protrusion of the underreamer blades 209 is re-adjusted (different from the first implementation of step 404). Steps 406 and 408 can then be repeated for the second level of radially outward protrusion of the underreamer blades 209. The second level of radially outward protrusion can be larger than the first level of radially outward protrusion at the first implementation of step 404, such that the second implementation of step 408 results in underreaming the wellbore to a larger diameter. This sequence of repeating the steps of method 400 (and similarly, repeating the steps of method 300) can be implemented for increasingly larger diameters as desired. Further, methods 300 and 400 can be repeated at various depths of the wellbore.

Figure 5:
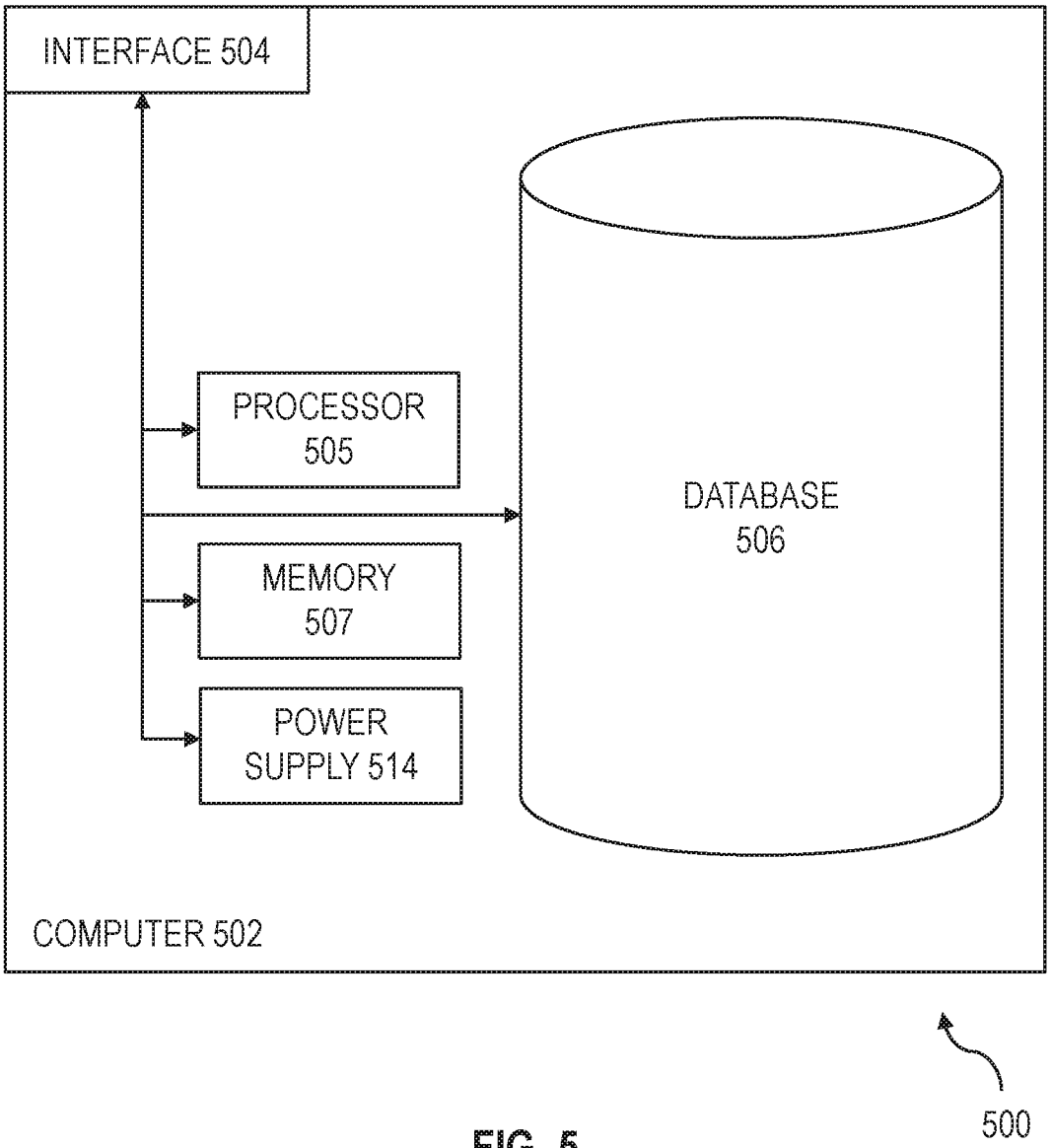
FIG. 5 is a block diagram of an example computer system that can be implemented in the system of FIG. 2A.

FIG. 5 is a block diagram of an example controller 500 used to provide computational functionalities associated with described algorithms, methods, functions, processes, flows, and procedures, as described in this specification, according to an implementation. The illustrated computer 502 is intended to encompass any computing device such as a server, desktop computer, laptop/notebook computer, one or more processors within these devices, or any other suitable processing device, including physical or virtual instances (or both) of the computing device. Additionally, the computer 502 can include a computer that includes an input device, such as a keypad, keyboard, touch screen, or other device that can accept user information, and an output device that conveys information associated with the operation of the computer 502, including digital data, visual, audio information, or a combination of information.

The computer 502 includes a processor 505. Although illustrated as a single processor 505 in FIG. 5, two or more processors may be used according to particular needs, desires, or particular implementations of the computer 502. Generally, the processor 505 executes instructions and manipulates data to perform the operations of the computer 502 and any algorithms, methods, functions, processes, flows, and procedures as described in this specification.

The computer 502 includes a memory 507 that can hold data for the computer 502 or other components (or a combination of both) that can be connected to the network. Although illustrated as a single memory 507 in FIG. 5, two or more memories 507 (of the same or combination of types) can be used according to particular needs, desires, or particular implementations of the computer 502 and the described functionality. While memory 507 is illustrated as an integral component of the computer 502, memory 507 can be external to the computer 502. The memory 507 can be a transitory or non-transitory storage medium.

The memory 507 stores computer-readable instructions executable by the processor 505 that, when executed, cause the processor 505 to perform operations, such as any of the steps of method 400. The computer 502 can also include a power supply 514. The power supply 514 can include a rechargeable or non-rechargeable battery that can be configured to be either user- or non-user-replaceable. The power supply 514 can be hard-wired. There may be any number of computers 502 associated with, or external to, a computer system containing computer 502, each computer 502 communicating over the network. Further, the term "client," "user," "operator," and other appropriate terminology may be used interchangeably, as appropriate, without departing from this specification. Moreover, this specification contemplates that many users may use one computer 502, or that one user may use multiple computers 502.

In some implementations, the computer 502 includes an interface 504. Although illustrated as a single interface 504 in FIG. 5, two or more interfaces 504 may be used according to particular needs, desires, or particular implementations of the computer 502. Although not shown in FIG. 5, the computer 502 can be communicably coupled with a network. The interface 504 is used by the computer 502 for communicating with other systems that are connected to the network in a distributed environment. Generally, the interface 504 comprises logic encoded in software or hardware (or a combination of software and hardware) and is operable to communicate with the network. More specifically, the interface 504 may comprise software supporting one or more communication protocols associated with communications such that the network or interface's hardware is operable to communicate physical signals within and outside of the illustrated computer 502.

In some implementations, the computer 502 includes a database 506 that can hold data for the computer 502 or other components (or a combination of both) that can be connected to the network. Although illustrated as a single database 506 in FIG. 5, two or more databases (of the same or combination of types) can be used according to particular needs, desires, or particular implementations of the computer 502 and the described functionality. While database 506 is illustrated as an integral component of the computer 502, database 506 can be external to the computer 502.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

As used in this disclosure, the terms "a," "an," or "the" are used to include one or more than one unless the context clearly dictates otherwise. The term "or" is used to refer to a nonexclusive "or" unless otherwise indicated. The statement "at least one of A and B" has the same meaning as "A, B, or A and B." In addition, it is to be understood that the phraseology or terminology employed in this disclosure, and not otherwise defined, is for the purpose of description only and not of limitation. Any use of section headings is intended to aid reading of the document and is not to be interpreted as limiting; information that is relevant to a section heading may occur within or outside of that particular section.

As used in this disclosure, the term "about" or "approximately" can allow for a degree of variability in a value or range, for example, within 10%, within 5%, or within 1% of a stated value or of a stated limit of a range.

As used in this disclosure, the term "substantially" refers to a majority of, or mostly, as in at least about 50%, 60%, 70%, 80%, 90%, 95%, 96%, 97%, 98%, 99%, 99.5%, 99.9%, 99.99%, or at least about 99.999% or more.

Values expressed in a range format should be interpreted in a flexible manner to include not only the numerical values explicitly recited as the limits of the range, but also to include all the individual numerical values or sub-ranges encompassed within that range as if each numerical value and sub-range is explicitly recited. For example, a range of "0.1% to about 5%" or "0.1% to 5%" should be interpreted to include about 0.1% to about 5%, as well as the individual values (for example, 1%, 2%, 3%, and 4%) and the sub-ranges (for example, 0.1% to 0.5%, 1.1% to 2.2%, 3.3% to 4.4%) within the indicated range. The statement "X to Y" has the same meaning as "about X to about Y," unless indicated otherwise. Likewise, the statement "X, Y, or Z" has the same meaning as "about X, about Y, or about Z," unless indicated otherwise.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described components and systems can generally be integrated together or packaged into multiple products.

Accordingly, the previously described example implementations do not define or constrain the present disclosure. Other changes, substitutions, and alterations are also possible without departing from the spirit and scope of the present disclosure.

What is claimed is:

1. A system comprising:

a housing defining a track comprising a plurality of catch points;

a guide shaft disposed within an inner bore of the housing;

a follower protruding radially outward from the guide shaft, the follower received by the track of the housing, wherein the follower and the track are cooperatively configured to restrict movement of the guide shaft relative to the housing to movement defined by the follower traveling along the track;

a plurality of underreamer blades, each underreamer blade of the plurality of underreamer blades configured to rotate and cut into a subterranean formation;

a hydraulic chamber disposed within the housing and coupled to the plurality of underreamer blades;

a guide cone coupled to the hydraulic chamber, the guide cone configured to adjust a level of radially outward protrusion of the plurality of underreamer blades based on a pressure within the hydraulic chamber, wherein each configuration of the follower being located at one of the catch points of the plurality of catch points of the track corresponds to a different pressure within the hydraulic chamber and, in turn, a different level of radially outward protrusion of the plurality of underreamer blades; and a controller communicatively coupled to the hydraulic chamber and the plurality the underreamer blades, the controller configured to:

detect whether the follower is located at any one of the catch points of the plurality of catch points of the track;

after detecting that the follower is located at one of the catch points of the plurality of catch points of the track, transmit a pressurization signal to the hydraulic chamber to adjust the pressure within the hydraulic chamber to a pressure level corresponding to the respective catch point at which the follower is located;

after the pressure within the hydraulic chamber has reached the pressure level, detect whether each underreamer blade of the plurality of underreamer blades is in contact with a wall of the subterranean formation; and after detecting that each underreamer blade of the plurality of underreamer blades is in contact with the wall of the subterranean formation, transmit an underreaming signal to the plurality of underreamer blades to rotate the plurality of underreamer blades, thereby cutting into the subterranean formation.

2. The system of claim 1, wherein the plurality of underreamer blades are configured to move between a retracted position and an extended position with a plurality of intermediate positions between the retracted position and the extended position, the extended position corresponding to the largest diameter of radially outward protrusion of the plurality of underreamer blades, each of the retracted position, the plurality of intermediate positions, and the extended position corresponding to a different catch point of the plurality of catch points of the track.

3. The system of claim 2, comprising a spring configured to bias the plurality of underreamer blades to the retracted position, and the hydraulic chamber is configured to generate sufficient pressure to resist the bias of the spring to move the plurality of underreamer blades from the retracted position.

4. The system of claim 3, wherein the plurality of underreamer blades are located between the spring and the guide cone.

5. The system of claim 4, wherein the track spans an entire circumference of an inner circumferential wall of the housing.

6. A method comprising:

positioning an apparatus within a wellbore in a subterranean formation, the apparatus comprising:

a housing defining a track comprising a plurality of catch points;

a guide shaft disposed within the housing;

a follower protruding radially outward from the guide shaft and received by the track of the housing, the follower and the track cooperatively configured to restrict movement of the guide shaft relative to the housing to movement defined by the follower traveling along the track;

a plurality of underreamer blades; and a hydraulic chamber disposed within the housing and coupled to the plurality of underreamer blades;

adjusting a rate of flow to the guide shaft to adjust a relative position of the guide shaft with respect to the housing until the follower is located at one of the catch points of the plurality of catch points of the track;

in response to the follower being located at the catch point of the track, adjusting a pressure within the hydraulic chamber to adjust a level of radially outward protrusion of the plurality of underreamer blades;

after adjusting the pressure within the hydraulic chamber, detecting whether each underreamer blade of the plurality of underreamer blades is in contact with a wall of the subterranean formation; and after detecting that each underreamer blade of the plurality of underreamer blades is in contact with the wall of the subterranean formation, rotating each underreamer blade of the plurality of underreamer blades to cut into the subterranean formation.

7. The method of claim 6, wherein the plurality of underreamer blades are configured to move between a retracted position and an extended position with a plurality of intermediate positions between the retracted position and the extended position, the extended position corresponding to the largest diameter of radially outward protrusion of the plurality of underreamer blades, each of the retracted position, the plurality of intermediate positions, and the extended position corresponding to a different catch point of the plurality of catch points of the track.

8. The method of claim 7, comprising adjusting the plurality of underreamer blades from the retracted position to any one of the intermediate positions or the extended position.

9. The method of claim 8, wherein the apparatus comprises a spring configured to bias the plurality of underreamer blades to the retracted position, and adjusting the pressure within the hydraulic chamber comprises generating sufficient pressure in the hydraulic chamber to resist the bias of the spring to move the plurality of underreamer blades from the retracted position to any one of the intermediate positions or the extended position.

10. The method of claim 9, wherein the apparatus comprises a guide cone coupled to the hydraulic chamber and in physical contact with the plurality of underreamer blades, the plurality of underreamer blades located between the spring and the guide cone, and adjusting the pressure within the hydraulic chamber results in adjusting a position of the guide cone to adjust the level of radially outward protrusion of the plurality of underreamer blades.

11. The method of claim 10, wherein the track spans an entire circumference of an inner circumferential wall of the housing.

12. A computer-implemented method comprising:

detecting whether a follower protruding from a guide shaft is located at any one catch point of a plurality of catch points of a track that is defined by a housing;

after detecting that the follower is located at one of the catch points of the plurality of catch points of the track, transmitting a pressurization signal to a hydraulic chamber disposed within the housing and coupled to a plurality of underreamer blades to adjust a pressure within the hydraulic chamber to a pressure level that corresponds to the respective catch point at which the follower is located, thereby adjusting a level of radially outward protrusion of the plurality of underreamer blades;

after the pressure within the hydraulic chamber has reached the pressure level, detecting whether each underreamer blade of the plurality of underreamer blades is in contact with a wall of a subterranean formation; and after detecting that each underreamer blade of the plurality of underreamer blades is in contact with the wall of the subterranean formation, transmitting an underreaming signal to the plurality of underreamer blades to rotate each underreamer blade of the plurality of underreamer blades, thereby cutting into the subterranean formation.

13. The computer-implemented method of claim 12, wherein:

transmitting the pressurization signal results in adjusting the plurality of underreamer blades to a first level of radially outward protrusion; and the computer-implemented method comprises:

after detecting that the follower is located at a different one of the catch points of the plurality of catch points of the track, transmitting a second pressurization signal to the hydraulic chamber to adjust the pressure within the hydraulic chamber to a second pressure level that corresponds to the respective catch point at which the follower is located, thereby adjusting the plurality of underreamer blades to a second level of radially outward protrusion;

after the pressure within the hydraulic chamber has reached the second pressure level, detecting whether each underreamer blade of the plurality of underreamer blades is in contact with the wall of the subterranean formation; and after detecting that each underreamer blade of the plurality of underreamer blades is in contact with the wall of the subterranean formation, transmitting a second underreaming signal to the plurality of underreamer blades to rotate each underreamer blade of the plurality of underreamer blades, thereby cutting into the subterranean formation.

14. The computer-implemented method of claim 12, comprising:

detecting an inner diameter of a wellbore in the subterranean formation;

comparing the detected inner diameter of the wellbore with a target inner diameter; and determining a pressure level within the hydraulic chamber corresponding to a level of radially outward protrusion of the plurality of underreamer blades that matches the target inner diameter.

15. The computer-implemented method of claim 14, comprising:

transmitting a second pressurization signal to the hydraulic chamber to adjust the pressure within the hydraulic chamber to the determined pressure level, thereby adjusting the plurality of underreamer blades to the level of radially outward protrusion that matches the target inner diameter;

after the pressure within the hydraulic chamber has reached the determined pressure level, detecting whether each underreamer blade of the plurality of underreamer blades is in contact with the wall of the subterranean formation; and after detecting that each underreamer blade of the plurality of underreamer blades is in contact with the wall of the subterranean formation, transmitting a second underreaming signal to the plurality of underreamer blades to rotate each underreamer blade of the plurality of underreamer blades, thereby cutting into the subterranean formation.

* * * * *